US008910785B2

(12) United States Patent
Loudenslager

(10) Patent No.: US 8,910,785 B2
(45) Date of Patent: Dec. 16, 2014

(54) GOLF BAG WITH A STABILIZATION AND REINFORCEMENT SYSTEM AND METHODS TO MANUFACTURE A GOLF BAG WITH THE STABILIZATION AND REINFORCEMENT SYSTEM

(75) Inventor: John H. Loudenslager, Phoenix, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 550 days.

(21) Appl. No.: 13/197,649

(22) Filed: Aug. 3, 2011

(65) Prior Publication Data

US 2013/0032499 A1 Feb. 7, 2013

(51) Int. Cl.
*A63B 55/04* (2006.01)

(52) U.S. Cl.
CPC ..... *A63B 55/045* (2013.01)
USPC ..... 206/315.7

(58) Field of Classification Search
CPC ..... A63B 55/00; A63B 55/10; A63B 55/06
USPC ..... 206/315.3, 315.7; 248/96
See application file for complete search history.

(56) References Cited

U.S. PATENT DOCUMENTS

| | | | | | |
|---|---|---|---|---|---|
| 400,895 | A | * | 4/1889 | Brown | 403/71 |
| 527,975 | A | * | 10/1894 | Hart | 16/387 |
| D42,259 | S | * | 3/1912 | McKinney | D8/327 |
| 1,599,183 | A | * | 9/1926 | Phillips | 296/97.13 |
| 1,769,011 | A | * | 7/1930 | Bickford | 248/96 |
| 4,834,235 | A | | 5/1989 | Solheim et al. | |
| 5,340,063 | A | | 8/1994 | Hsieh | |
| 5,351,921 | A | | 10/1994 | Chen | |
| 5,415,285 | A | | 5/1995 | Reimers | |
| 5,597,144 | A | * | 1/1997 | Lee | 248/96 |
| 5,762,189 | A | | 6/1998 | Reimers | |
| 5,996,789 | A | * | 12/1999 | Suggs et al. | 206/315.3 |
| 6,311,937 | B1 | | 11/2001 | Han | |
| 6,435,345 | B1 | | 8/2002 | Wang | |
| 6,474,606 | B1 | * | 11/2002 | Cheng | 248/96 |
| 6,494,416 | B2 | * | 12/2002 | Wang | 248/96 |
| 7,017,869 | B2 | * | 3/2006 | Wang | 248/96 |
| 7,617,931 | B2 | | 11/2009 | Shiao | |
| 7,870,954 | B2 | * | 1/2011 | Quartarone, III | 206/315.7 |
| 2006/0108244 | A1 | | 5/2006 | Tan | |
| 2007/0246384 | A1 | * | 10/2007 | Shiao | 206/315.7 |
| 2009/0308768 | A1 | * | 12/2009 | Quartarone | 206/315.7 |
| 2011/0005949 | A1 | * | 1/2011 | Shiao | 206/315.7 |
| 2012/0279883 | A1 | * | 11/2012 | Lai | 206/315.7 |

OTHER PUBLICATIONS

International Search Report and Written Opinion for International Application No. PCT/US2012/049476 dated Feb. 27, 2013.

* cited by examiner

*Primary Examiner* — Tri Mai

(57) ABSTRACT

Embodiments of golf bag having a stabilization and reinforcement system and methods to manufacture such a golf bag are generally described herein. Other embodiments of a golf bag having a stabilization and reinforcement system including a first bracket engaged to a second bracket through a flexible rod may be described and claimed.

15 Claims, 9 Drawing Sheets

GOLF BAG WITH A STABILIZATION AND REINFORCEMENT SYSTEM AND METHODS TO MANUFACTURE A GOLF BAG WITH THE STABILIZATION AND REINFORCEMENT SYSTEM

FIELD

The present disclosure relates to golf bags with an extensible bag stand, and in particular to golf bags having an extensible bag stand with a stabilization and reinforcement system.

BACKGROUND

Most golf bags may be in the form of a tubular fabric or leather container having a generally cylindrical configuration with a closed bottom end and an open top end through which golf clubs are inserted into and removed from the golf bag. Although golf bags are manufactured in a variety of sizes and materials so as to better suit various intended uses, golf bags are conventionally grouped into two basic classes. The first class of golf bags are relatively larger and heavier golf bags designed to be carried by a pull cart or transported by a golf cart, while the second class of golf club bags are generally smaller and lighter golf bags designed to be carried by the individual during play.

The second class of golf bags are usually referred to as "carry bags" which are carried by the individual using a carrying strap that may be used to lift and carry the golf bag. Many of these types of carry bags have an extensible bag stand devised for supporting the golf bag in a substantially upright angular position whenever the individual sets down the golf bag on a surface. A widely used and well known extensible golf bag stand has been devised for demountable attachment to the side of golf bags and is disclosed in U.S. Pat. No. 4,834,235 which describes a golf bag stand having a pair of legs with one end pivotally attached to one portion of the golf bag and another end engaged to a retraction mechanism. The retraction mechanism is configured to operate with a toggle mechanism that causes the retraction mechanism to retract and collapse the pair of legs from a deployed position to a retracted position whenever the golf bag is lifted and carried by the individual. In addition, such carry bags having an extensible bag stand may include a stabilization system that allows the closed bottom end of the golf bag to remain substantially flat and along the same plane when the golf bag is placed from a substantially upright position when initially placed on a surface to a substantially upright angled position after the pair of legs of the extensible bag stand have been deployed. Known stabilization systems that allow the closed bottom end of the golf bag to remain on the same plane between the substantially upright position to the substantially upright angled position may include a bottom portion disposed adjacent or proximate to the closed bottom end of the golf bag and an top portion disposed adjacent or proximate to the open top end of the golf bag. The stabilization system further includes a flexible rod having a first end engaged to the top portion and a second end disposed within a pocket formed by the fabric of the golf bag adjacent or proximate to the bottom portion located along the closed bottom end of the golf bag. In addition, the stabilization system allows the closed bottom end of the golf bag to flex slightly when the golf bag is placed on a surface and the extensible bag stand is deployed such that the golf bag assumes a substantially upright angled position. However, the flexible rod can become loose or disengaged from the fabric pocket at times, which can require the individual to take the time to adjust or reinsert the flexible rod back into the fabric pocket.

BRIEF DESCRIPTION OF THE DRAWINGS

Corresponding reference characters indicate corresponding elements among the various views of the drawings. The headings used in the figures should not be interpreted to limit the scope of the claims.

DETAILED DESCRIPTION

As described herein, a golf bag having an extensible bag stand with a stabilization and reinforcement system, and methods of manufacturing such a golf bag with the stabilization and reinforcement system is configured to provide stability and structural reinforcement as the golf bag is placed from a substantially upright position when initially placed on a surface to an angular position when the extensible bag stand is deployed. The stabilization and reinforcement system includes a rod having a first end engaged to a top portion located adjacent or proximate the open top end of the golf bag, and a second end engaged to a bottom portion located adjacent or proximate the closed bottom end of the golf bag. In addition, the second end of the rod is engaged to a hinge secured to the bottom portion that establishes a secure connection with a pivot point that allows the rod to pivot while the bottom portion and the closed bottom end of the golf bag maintain a substantially parallel orientation relative to the surface.

Figure 1:
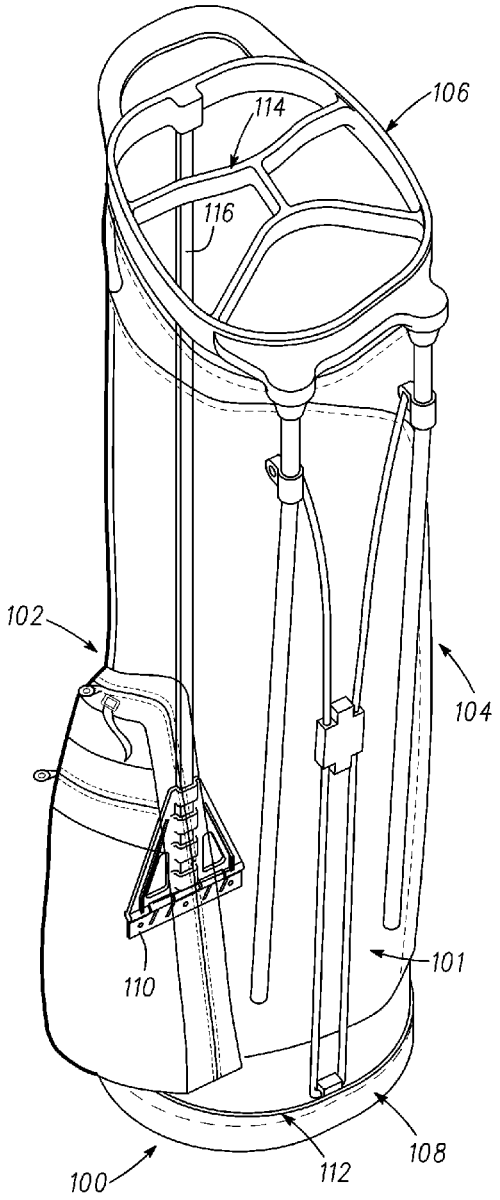
FIG. 1 is perspective view of a golf bag having an extensible bag stand showing the stabilization and reinforcement system.
Figure 2:
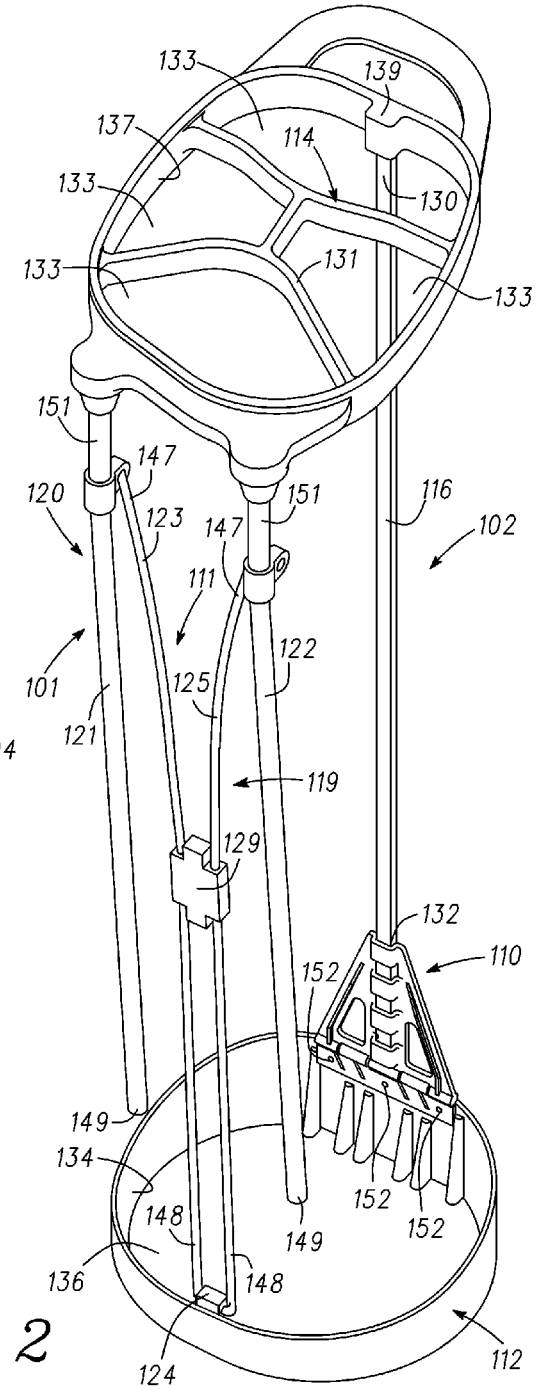
FIG. 2 is an elevated perspective view of the extensible bag stand with the stabilization and reinforcement system.
Figure 3:
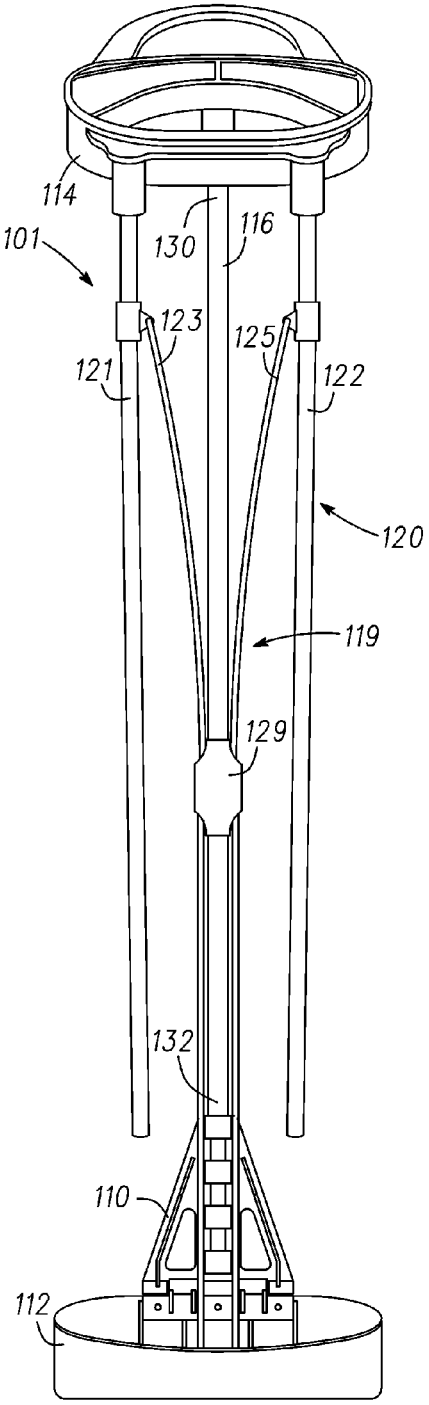
FIG. 3 is a front view of the extensible bag stand with the stabilization and reinforcement system.
Figure 4:
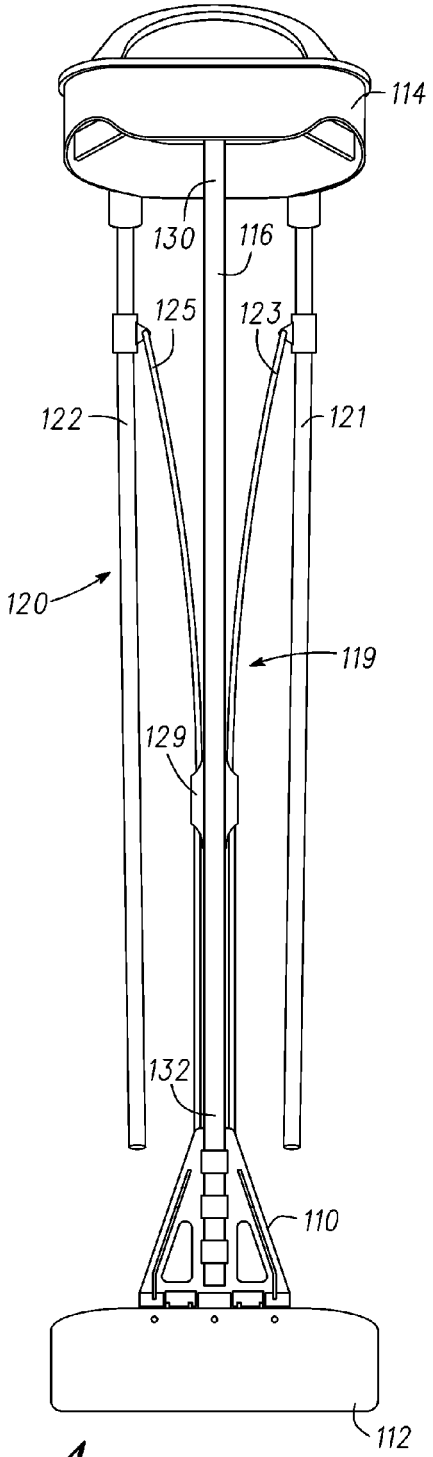
FIG. 4 is a rear view of the extensible bag stand with the stabilization and reinforcement system.
Figure 5:
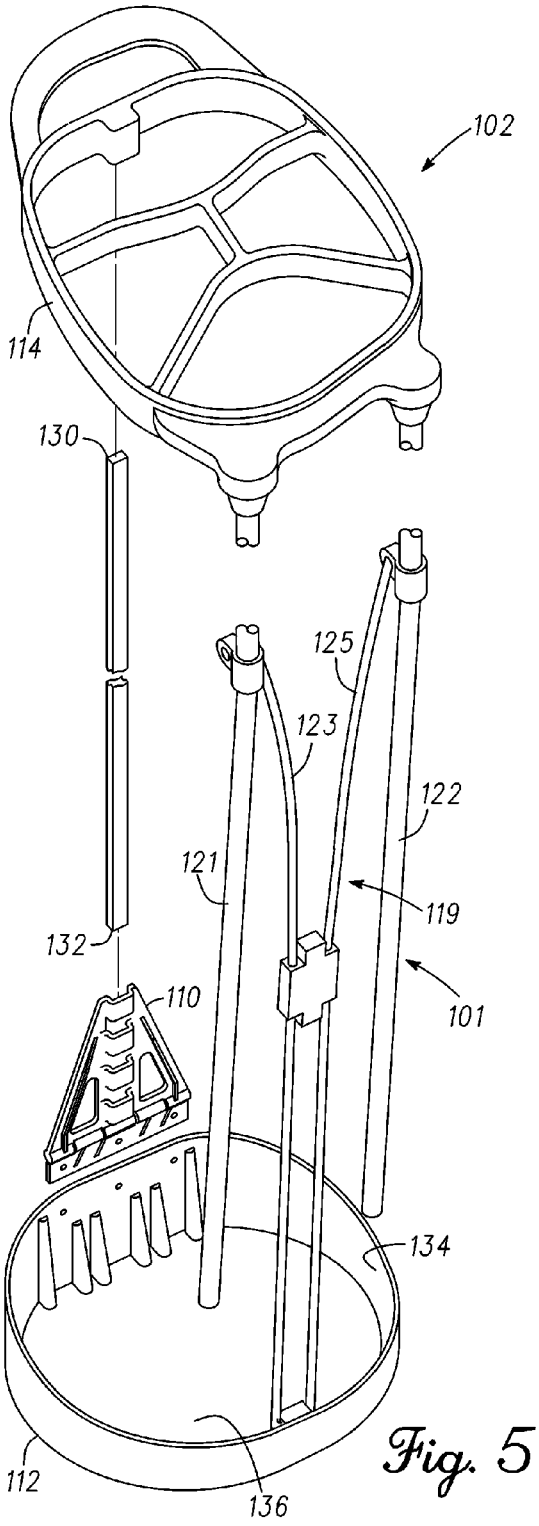
FIG. 5 is an exploded view of the extensible bag stand with the stabilization and reinforcement system.

Referring to the drawings, an embodiment of a golf bag is illustrated and generally indicated as 100 in FIG. 1. In general, the golf bag 100 includes a body 104 defining an open top end 106 and a closed bottom end 108. As shown, the body 104 includes an extensible bag stand 101 for supporting the body 104 in an angular position when an individual sets down the golf bag 100 on a surface 900 (FIGS. 9-13). Referring to FIG. 2, the extensible bag stand 101 includes a retraction mechanism 111 having an upper end 147 connected to a plurality of legs 120 and a lower end 148 connected to a toggle switch mechanism 124 for retracting the plurality of legs 120 when the extensible bag stand 101 is placed from the deployed position to the retracted position. In one embodiment, the plurality of legs may be first leg 121 and a second leg 122.

As used herein the term "deployed position" shall mean the position of the plurality of legs 120 being substantially deployed outwardly from the body 104 when the individual sets the golf bag 100 down such that the plurality of legs 120 contact the surface 900, wherein the term "retracted position" shall mean the position of the plurality of legs 120 being substantially retracted inwardly towards the body 104 such that the plurality of legs 120 no longer contact the surface 900 as the individual lifts up the golf bag 100.

The retraction mechanism 111 for the extensible bag stand 101 may be a spring wire 119 made of a resilient metallic material that bias the plurality of legs 120 outwardly when the body 104 is placed in the deployed position and then retracts the plurality of legs 120 inwardly to the retracted position whenever the body 104 is lifted off surface 900. The spring wire 119 may be a single wire arrangement or a plurality of wires. Alternatively, the spring wire 119 may be made from any other resilient material, such as plastic or a metallic composite, capable of repeatedly applying a bias to the plurality of legs 120 in either the deployed position or the retracted position by the extensible bag stand 101.

As shown, one example of the spring wire 119 may be first and second wires 123 and 125 that engage the respective pair of legs 121 and 122. Specifically, the upper end 147 of the first and second wires 123 and 125 engage a respective leg 121 and 122, while the lower end 148 of the first and second wires 123 and 125 engage the toggle switch mechanism 124 that forms a part of the extensible bag stand 101 for causing either the deployed position or the retracted position of the plurality of legs 120 by the extensible bag stand 101.

As further shown, the pair of legs 121 and 122 each define a first end 149 configured to support the body 104 in a substantially upright position on the surface 900 as well as a second end 151 that may be pivotally engaged to an top portion 114 attached proximate or adjacent to the open top end 106 of the golf bag 100. The pivotal engagement of each second end 151 to the top portion 114 may be a pin and socket arrangement which allows movement of the plurality of legs 120 along a two-dimensional plane or a ball and socket arrangement that allows movement of the plurality of legs 120 along a three-dimensional plane. In one embodiment, the structure and operation of the extensible bag stand 101 may be the extensible bag stand disclosed in U.S. Pat. No. 4,834,235, which is incorporated by reference in its entirety. However, the apparatus, articles of manufacture, and methods described herein are not limited in this regard.

Referring to FIGS. 2-5, in one embodiment the extensible bag stand 101 includes a stabilization and reinforcement system 102 that provides a means for reinforcing the structure of the golf bag 100 as well as stabilize the golf bag 100 when the golf bag 100 is placed from a substantially upright position when initially set on the surface 900 to an angular position when the extensible bag stand 101 places the golf bag 100 in the deployed position. As shown, the stabilization and reinforcement system 102 includes a bottom portion 112 engaged to the top portion 114 through a rod 116. The rod 116 defines a first end 130 configured to engage a receptacle 139 formed along a side portion 137 of the top portion 114 to secure the rod 116 therein and a second end 132 configured to engage a hinge 110 that is engaged to the bottom portion 112 for permitting the rod 116 to pivot when the golf bag 100 is placed in the deployed position. In some embodiments, the first end 130 of the rod 116 may be formed integral with the top portion 114. In some embodiments, the rod 116 may be elongated such that the rod 116 extends substantially the length of the body 104. In addition, the rod 116 may be made from a flexible material that permits the rod 116 to bend or flex under stress.

As shown in FIG. 2, the top portion 114 forms a divider 131 that is configured to form a plurality of openings 133 for permitting one or more golf clubs (not shown) to be inserted through the open top end 106 of the elongated tubular body 104. The bottom portion 112 includes a side portion 134 that surrounds a lower portion 136. In one arrangement, the toggle switch mechanism 124 is secured to one part of the side portion 134 and the hinge 110 is secured to an opposing part of the side portion 134 along the bottom portion 112.

Referring to FIGS. 6-10, the hinge 110 includes a hinge body 115 having a base portion 126 and a back portion 128 with a pivot portion 150 formed between the base and back portions 126 and 128 that permits the back portion 128 to pivot relative to the base portion 126. The hinge body 115 defines a front surface 117 and a rear surface 118. As further shown, the back portion 128 defines a generally triangular configuration forming a bottom side 153 and a top side 154 bounded by a first side 155 and an opposing second side 156, while the base portion 126 defines a generally rectangular configuration forming a bottom side 157 and a top side 158 bounded by a third side 159 and an opposing fourth side 160. Although the above example may describe and the figures may depict a particular shape for the back portion 128 of the hinge 110, the apparatus, systems, methods, and article of manufacture described herein may be include a back portion 128 of the hinge 110 may be other suitable shapes (e.g., rectangular configuration, lock-step configuration, U-shaped configuration, etc.).

Figure 6:
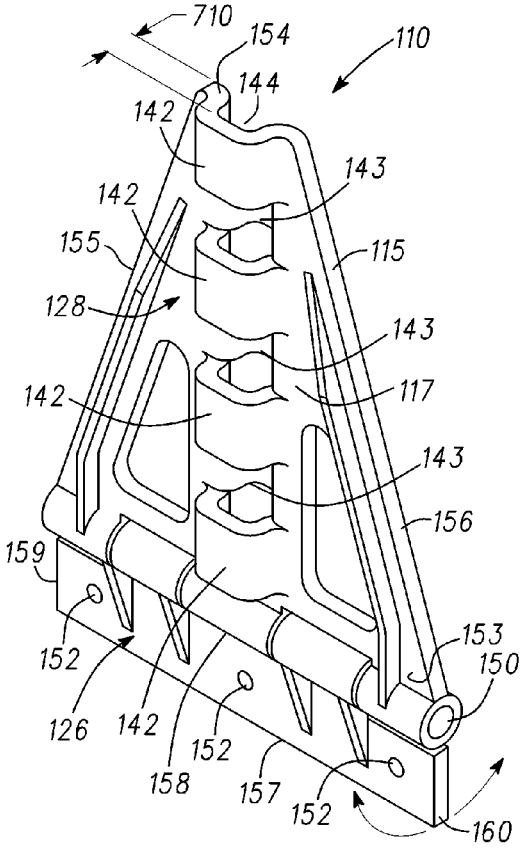
FIG. 6 is a perspective view of a hinge used in the stabilization and reinforcement system.
Figure 7:
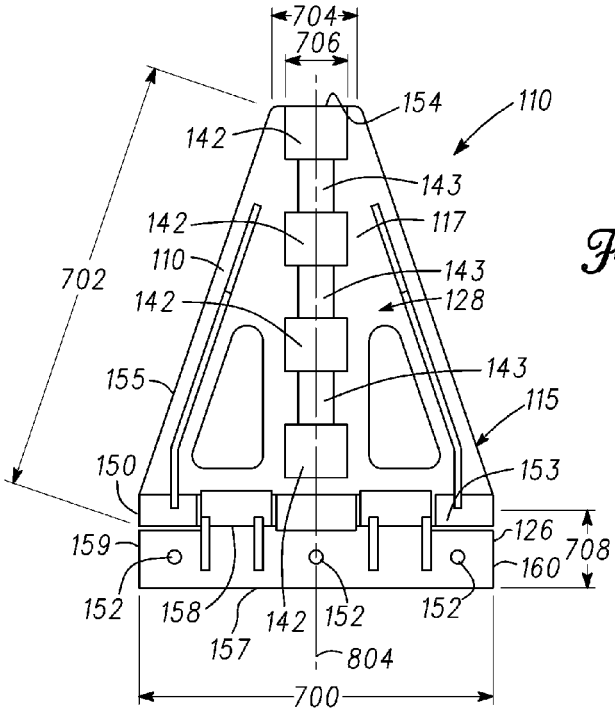
FIG. 7 is a front view of the hinge.
Figure 8:
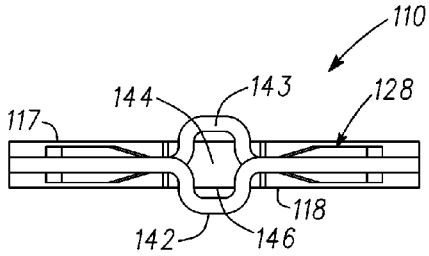
FIG. 8 is a top view of the hinge.

Referring to FIGS. 6 and 7, the base portion 126 forms a plurality of openings 152 configured to receive a respective plurality of screws (not shown) that secure either the front surface 117 or rear surface 118 of the hinge body 115 to the bottom portion 112. In one embodiment shown in FIG. 2, the rear surface 118 of the hinge body 115 may be secured proximate or adjacent to a lip 145 formed along the edge of the side portion 134 defined by the bottom portion 112.

Figure 10:
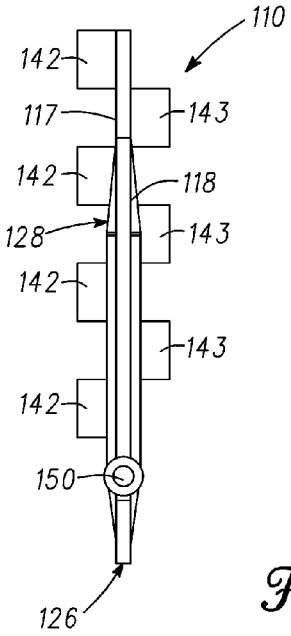
FIG. 10 is a side view of the hinge.
Figure 9:
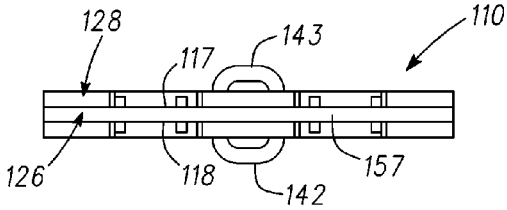
FIG. 9 is a bottom view of the hinge.

As shown in FIGS. 6-10, the back portion 128 of the hinge 110 defines a center spine 144 that forms a plurality of first raised portions 142 in juxtaposition with a respective plurality of second raised portions 143. Referring to FIG. 10, the plurality of first raised portions 142 extends outwardly from the front surface 117 and the plurality of second raised portions 143 extends outwardly from the rear surface 118 in alternate opposing fashion relative to each other to collectively form a central channel 146 (FIG. 8) along a latitudinal axis 804 (FIG. 7) of the central spine 144. In one embodiment, the central channel 146 is configured to receive and secure the distal end 132 of the rod 116 therein.

Referring specifically to FIGS. 6 and 7, in one embodiment the back portion 128 of the hinge 110 may have dimensions in which the first and second sides 155 and 156 have a length 702 of 4.5 inches, the top side 154 has a length 704 of 1 inch, and the bottom side 153 has a length 700 of 4 inches, the top side 154 has a thickness 710 of 0.25 inches, and the center spine 144 formed by the back portion 128 has an inner diameter 706 of 0.5 inches. In one embodiment, the base portion 126 may have dimensions in which the third side 159 has a length 708 of 0.875 inches and fourth side 160 has the same length 708 of 0.875 inches. In some embodiments, length 700 may be between 2 inches and 6 inches, length 702 may be between 2 inches and 7 inches, the length 704 may be between 0.5 inches and 1.5 inches, the inner diameter 706 may be between 0.25 inches and 1 inches, the length 708 is between 2.5 inches and 0.5 inches, and the thickness 710 may be between 0.125 inches and 1 inches. Though particular dimensions for the invention are listed above, the dimensions are not limited in this regard.

While the above examples may describe and the figures may depict the apparatus, systems, methods, and articles of manufacture with multiple components as separate parts, two or more of these components may be a single integral part. In one example, the hinge 110 and the bottom portion 114 may be a single integral part. In another example, the hinge 110 and the rod 116 may be a single integral part. In yet another example, the top portion 112 and the rod 116 may be a single integral part. The apparatus, systems, methods, and articles of manufacture described herein are not limited in this regard.

Figure 11:
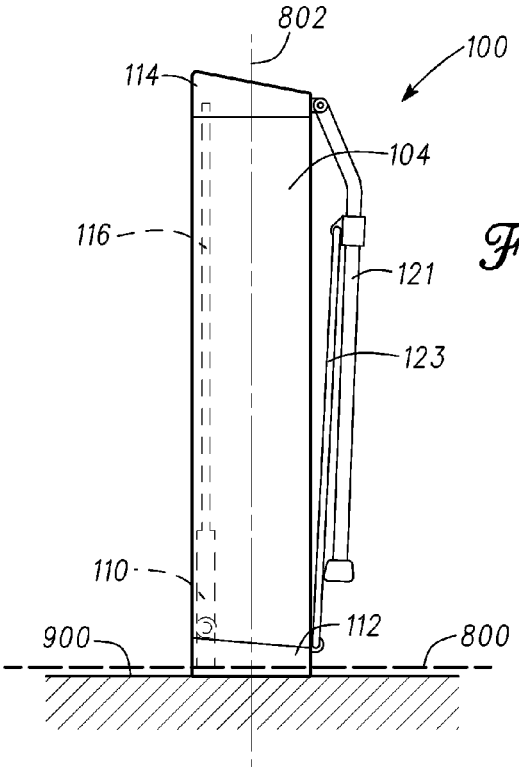
FIG. 11 is an illustration showing the golf bag with the extensible bag stand in a substantially upright position.
Figure 12:
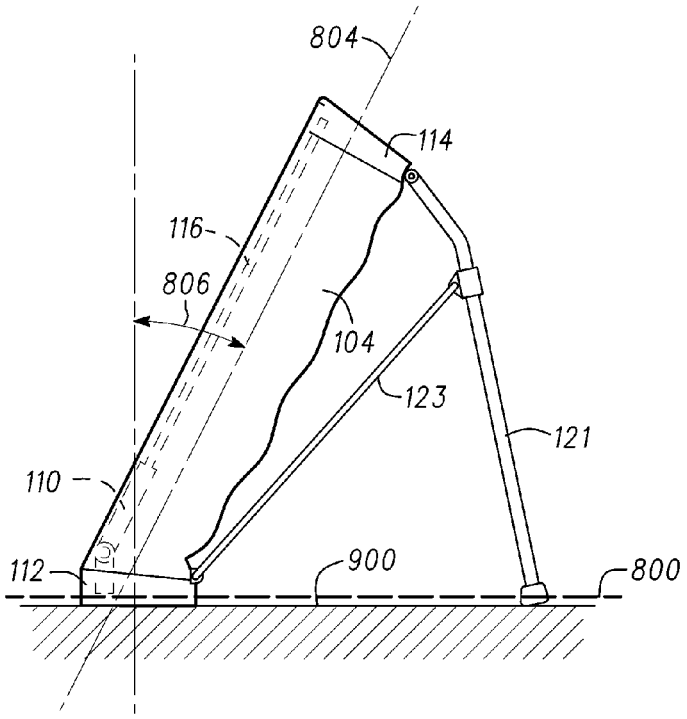
FIG. 12 is an illustration showing the golf bag with the extensible bag stand in an angled position.

Referring to FIGS. 11 and 12, the golf bag 100 is shown in a substantially upright position (FIG. 11) with the extensible bag stand 101 in the retracted position and in a substantially angular upright position (FIG. 12) with the extensible bag stand 101 in the deployed position. As shown in FIG. 11, when the golf bag 100 is set on the surface 900 in the substantially upright position the upper and bottom portions 112 and 114 of the stabilization and reinforcement system 102 are substantially aligned in parallel with longitudinal axis 800 and the rod 116 is substantially aligned in parallel with latitudinal axis 802. When the extensible bag stand 101 is in the deployed position as shown in FIG. 12, the top portion 114 and rod 116 is aligned along center axis 804, which is offset by a range of motion 806 from the latitudinal axis 802, while the bottom portion 112 remains substantially aligned in parallel along longitudinal axis 800 due to the swiveling operation of the hinge 110 in which the back portion 128 rotates relative to the stationary base portion 126 along the pivot portion 150.

Figure 13:
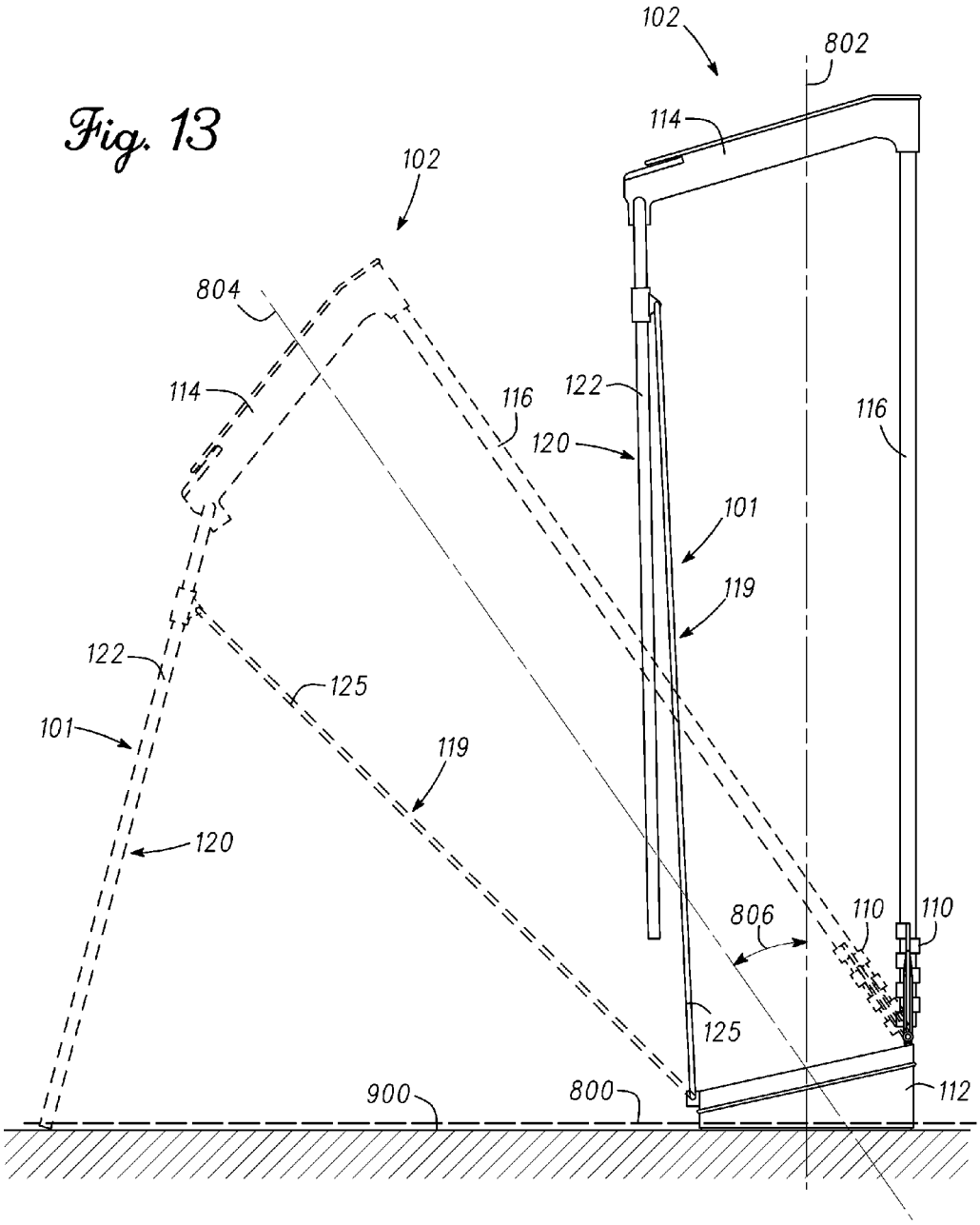
FIG. 13 is a side view showing a sequence of the extensible bag stand in a substantially upright position to an angled position in phantom.
Figure 14:
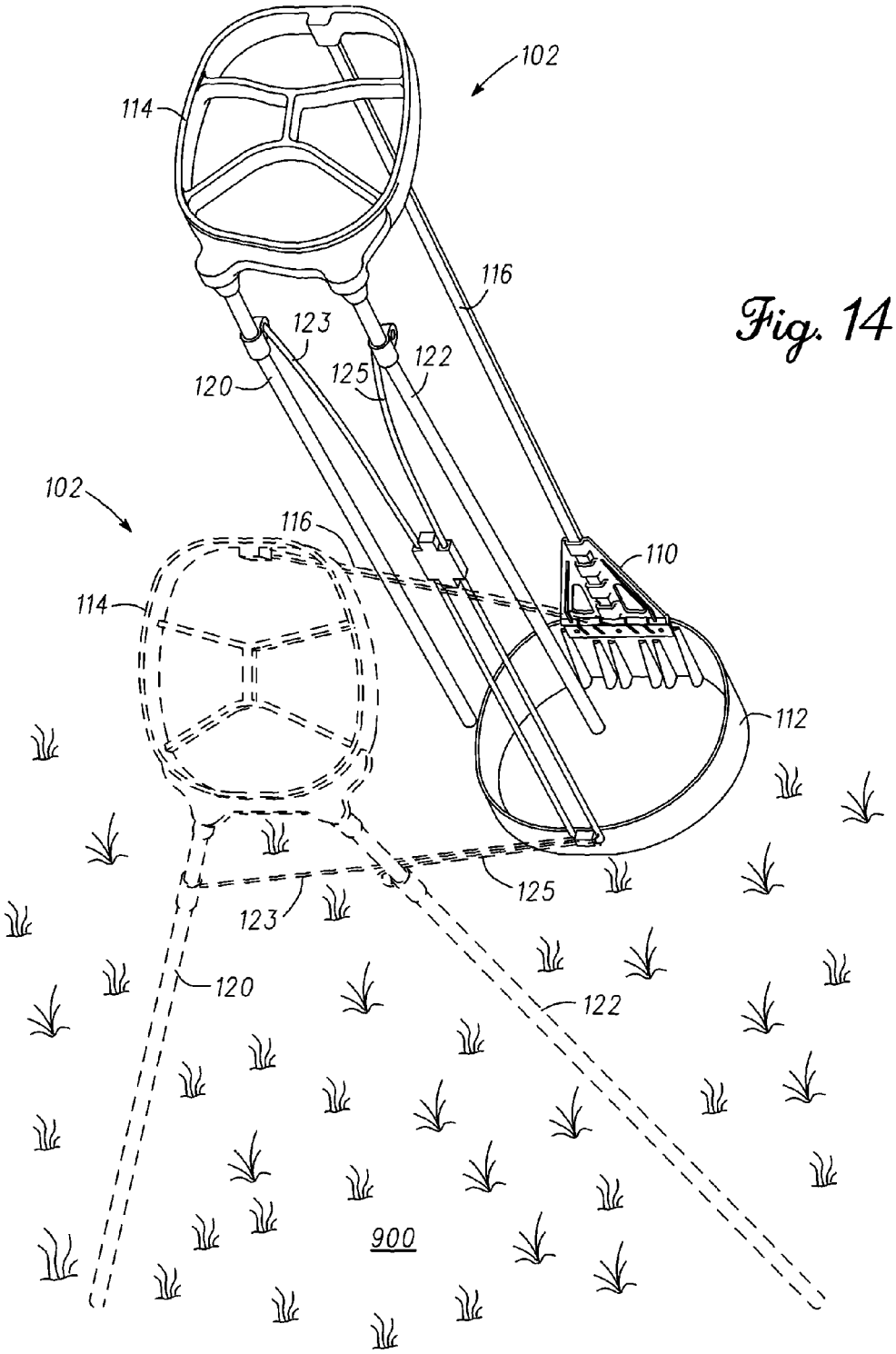
FIG. 14 is a perspective view showing the sequence of the extensible bag stand shown in FIG. 13.
Figure 15:
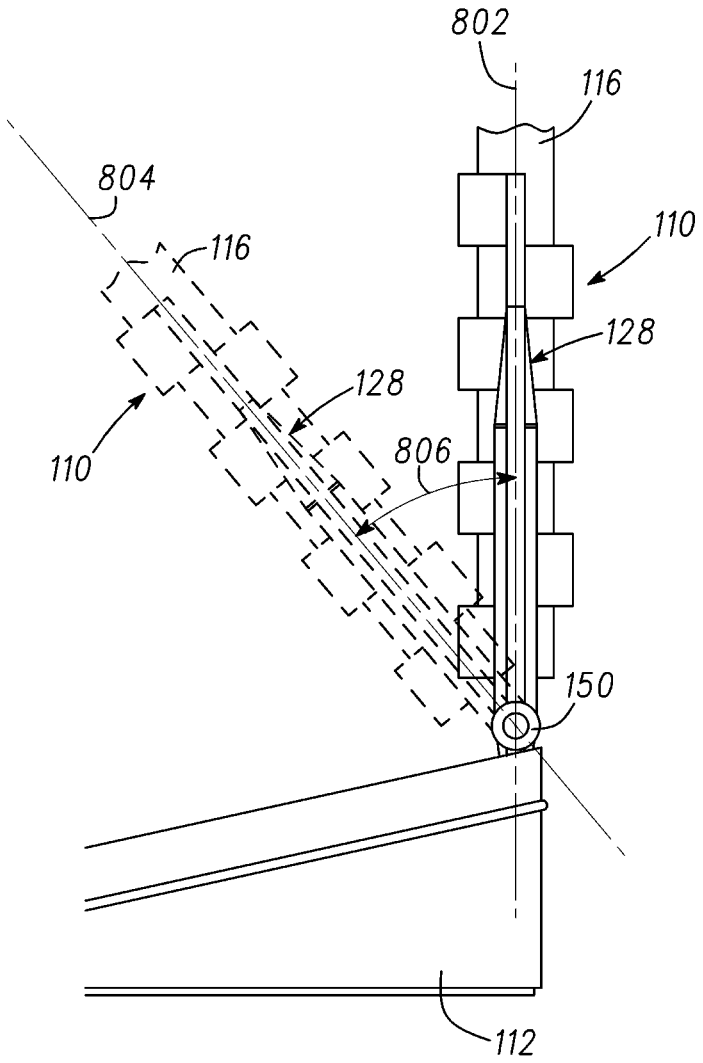
FIG. 15 is an enlarged view showing the pivot of the hinge when the extensible bag stand is placed from a substantially upright position to an angled position.

Referring to FIGS. 13 and 14, the stabilization and reinforcement system 102 is illustrated when the extensible bag stand 102 is in the retracted position and in the deployed position (shown in phantom). As noted above, when the extensible bag stand 101 is in the retracted position the rod 116 is substantially parallel with the latitudinal axis 802 and substantially perpendicular with the longitudinal axis 800, while the extensible bag stand 101 is in the deployed position the rod 116 is substantially parallel with the center axis 804, which forms a range of motion 806 relative to the latitudinal axis 802. For example, the range of motion 806 may be between 45 degrees to 90 degrees. In addition, the bottom portion 112 remains substantially parallel with the longitudinal axis 800 regardless of whether the extensible bag stand 101 is in the retracted or deployed position since the pivot portion 150 of the hinge 110 allows the back portion 128 to pivot relative to the stationary base portion 126 as illustrated in FIG. 15. As such, the arrangement of the rod 116 having the first end 130 secured to the top portion 114 and the second end 132 engaged to the hinge 110 stabilizes the golf bag 100 when the extensible bag stand 101 is in the deployed position, while also providing a frame that structurally reinforces the golf bag 100. The pivot portion 150 may be any structural arrangement that permits the back portion 128 to pivot relative to the base portion 126.

Figure 16:
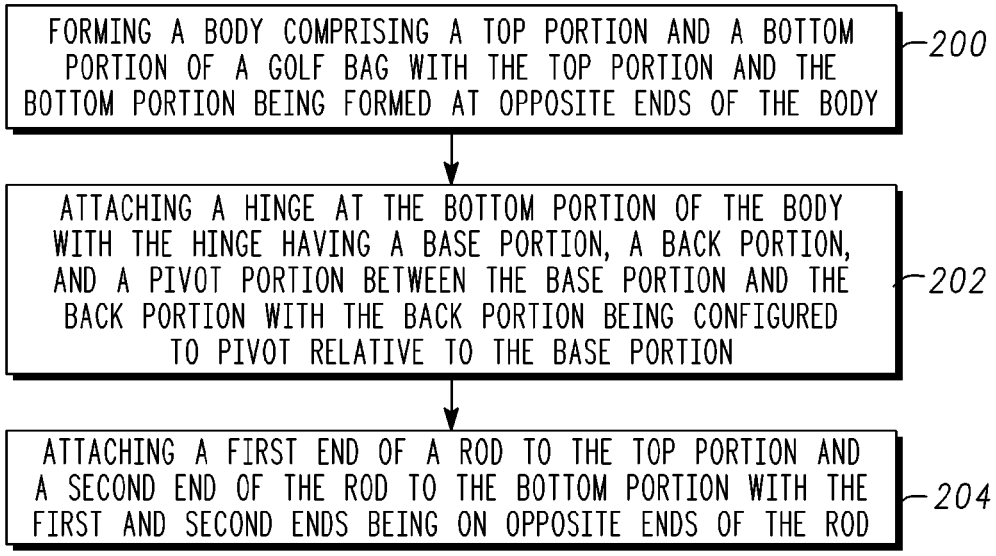
FIG. 16 is a flow chart illustrating a method for manufacturing a golf bag with the extensible bag stand having the stabilization and reinforcement system.

Referring to FIG. 16, a flow chart is shown illustrating a method for manufacturing the golf bag 100 having the extensible bag stand 101 with the stabilization and reinforcement system 102. At block 200, forming a body 104 comprising a top portion 114 and a bottom portion 112 with the top portion 114 and bottom portion 112 being formed at opposite ends of the body 104. At block 202, attaching a hinge 110 to the bottom portion 112 of the body 104 with the hinge 110 having a base portion 126, a back portion 128, and a pivot portion 150 between the base portion 126 and the back portion 128 with the back portion 128 being configured to pivot relative to the base portion 126. At block 204, attaching a first end 130 of a rod 116 to the top portion 114 and a second end 132 of the rod 116 to the bottom portion 112 with the first and second ends 130 and 132 being on opposite ends of the rod 116. In some embodiments, one or more first raised portions 142 and one or more second raised portions 143 may be formed on the back portion 128 of the hinge 110 to form a channel 146 to receive a portion proximate to the first end 130 of the rod 116. In some embodiments, at least one of the one or more first raised portions 142 may be formed in opposing juxtaposition relative to at least one or more second raised portions 143 to form the channel 146. In addition, the back portion 128 and base portion 126 of the hinge 110 may be configured to form an angle of about 180 degrees when the golf bag 100 is in a substantially upright position and an angle less than 180 degrees when the golf bag is in an angled position.

While the figures may depict a top portion of a golf bag with a particular number of dividers and openings to receive one or more golf clubs, the apparatus, systems, methods, and articles of manufacture described herein may include a top portion with more or less dividers or openings to receive golf clubs (e.g., a three-way top, a five-way top, a six-way top, a fourteen-way top, etc.). Although the figures may depict an extensible bag stand with a particular number of deployable legs, the apparatus, systems, methods, and articles of manufacture described herein may include an extensible bag stand with more or less deployable legs.

Further, while the figures may depict a particular type of bottom portion of a golf bag (e.g., the height of the bottom portion decreases in a linear manner from one end to the opposite end), the apparatus, systems, methods, and articles of manufacture may be applicable to other type of bottom portions (e.g., the height of the bottom portion decreases in a non-linear manner (e.g., lock step). Although the above examples may be describe and the figures may depict a carry golf bag, the apparatus, systems, methods, and articles of manufacture described herein may be applicable to cart golf bags, travel bags for golf bags, or other suitable type of bags (e.g., luggage, etc.). Alternatively, the apparatus, systems, methods, and articles of manufacture described herein may be applicable to tripods for cameras, camcorders, and/or other electronic devices.

It should be understood from the foregoing that, while particular embodiments have been illustrated and described, various modifications can be made thereto without departing from the spirit and scope of the invention as will be apparent to those skilled in the art. Such changes and modifications are within the scope and teachings of this invention as defined in the claims appended hereto.

What is claimed is:

1. A system comprising:

a top portion of a bag;

a bottom portion of the bag, wherein the bag defines an exterior surface and an interior surface;

a rod having a first end and a second end, wherein the first end of the rod is engaged to the top portion; and a hinge engaged to the bottom portion, the hinge having a base portion and a back portion with a pivot portion between the base portion and the back portion, wherein the back portion defines a channel, wherein the back portion is configured to rotate relative to base portion such that the back portion does not contact the bottom portion of the bag, wherein the base portion of the hinge is engaged to the interior surface of the bag, and the channel of the back portion of the hinge is engaged to the second end of the rod.

2. The system of claim 1, wherein the base portion of the hinge is engaged to a side portion of the bottom portion.

3. The system of claim 1, wherein the back portion of the hinge comprises one or more first raised portions and one or more second raised portions that collectively form the channel configured to receive the second end of the rod.

4. The system of claim 3, wherein at least one of the one or more first raised portions is in juxtaposition relative to at least one or more second raised portions.

5. The system of claim 1, wherein the back portion of the hinge is configured to pivot relative to the base portion of the hinge.

6. The system of claim 1, wherein the back portion of the hinge has a substantially triangular configuration.

7. A golf bag comprising:

a body having a bottom portion and a top portion in communication with a chamber extending between the top and bottom portion, the chamber configured to receive one or more golf clubs, wherein the body defines an exterior surface and an interior surface;

an extensible bag stand coupled to the body, the extensible bag stand including one or more deployable legs and a rod having a first end and a second end, the first end of the rod being engaged to the top portion; and a hinge having a base portion, a back portion and a pivot portion between the base portion and the back portion, wherein the back portion is configured to rotate relative to base portion such that the back portion does not contact the bottom portion of the body, wherein the back portion defines a channel, and wherein the base portion of the hinge is engaged to the interior surface of the body and the channel of the back portion of the hinge is engaged to the second end of the rod.

8. The golf bag of claim 7, wherein the rod is disposed longitudinally along the body of the golf bag.

9. The golf bag of claim 7, wherein the back portion of the hinge defines one or more first raised portions and one or more second raised portions that collectively form the channel configured to receive the second end of the rod.

10. The golf bag of claim 9, wherein at least one of the one or more first raised portions is in opposing juxtaposition relative to at least one of the one or more second raised portions.

11. The golf bag of claim 7, wherein the back portion of the hinge is configured to pivot relative to the base portion of the hinge.

12. The golf bag of claim 7, wherein the bottom portion is substantially parallel to a surface when the extensible bag stand is deployed and the body is in an angled position.

13. The golf bag of claim 12, wherein the bottom portion is substantially parallel to the surface when one or more deployable legs of the extensible bag stand extend from a retracted position to a deployed position.

14. The golf bag of claim 7, the back portion and the base portion of the hinge form an angle of about 180 degrees when the body is in a substantially upright position, and wherein the back portion and the base portion of the hinge form an angle of less than 180 degrees when the body is in an angled position.

15. The golf bag of claim 7, wherein the back portion and the base portion of the hinge form an angle of about 180 degrees when one or more deployable legs of the extensible bag stand is in a retracted position and wherein the back portion and the base portion of the hinge form an angle less than 180 degrees when the one or more deployable legs of the extensible bag stand is in a deployed position.

* * * * *